US007546844B2

(12) United States Patent
Al-Mutairi

(10) Patent No.: US 7,546,844 B2
(45) Date of Patent: Jun. 16, 2009

(54) PORTABLE CAR COVER

(76) Inventor: Mansour A. Al-Mutairi, Block 3. Street 35, House 27, Alqurain (KW)

( * ) Notice: Subject to any disclaimer, the term of this patent is extended or adjusted under 35 U.S.C. 154(b) by 27 days.

(21) Appl. No.: 11/468,902

(22) Filed: Aug. 31, 2006

(65) Prior Publication Data

US 2008/0053504 A1 Mar. 6, 2008

(51) Int. Cl.
*E04H 15/06* (2006.01)

(52) U.S. Cl. ..... 135/88.06; 135/143

(58) Field of Classification Search ..... 135/88.06, 135/119, 121, 128, 143; 52/83, 63; 296/95.1; 403/92, 93, 95
See application file for complete search history.

(56) References Cited

U.S. PATENT DOCUMENTS 2,052,331 A * 8/1936 White ..... 172/372
3,795,933 A * 3/1974 Seufert ..... 15/114
3,870,061 A * 3/1975 Lowery ..... 135/88.07
4,605,030 A * 8/1986 Johnson ..... 135/88.06
5,579,610 A * 12/1996 Jackson ..... 52/4
7,172,234 B2 * 2/2007 Chang ..... 296/95.1
2004/0050413 A1 * 3/2004 Cooper ..... 135/143

* cited by examiner

*Primary Examiner*—David R Dunn
*Assistant Examiner*—Danielle Jackson
(74) *Attorney, Agent, or Firm*—Lowe Hauptman Ham & Berner, LLP

(57) ABSTRACT

A portable car cover includes a flexible sheet like cover of plastic or fabric and four extendable or foldable legs. Each of the legs is connected to a base member by an adjustment mechanism for positioning the upper ends of the legs to stretch the cover over an automobile. The base members are held in place by the tires of the automobile and the adjustment mechanism angularly off set the legs in a longitudinal and lateral direction.

12 Claims, 4 Drawing Sheets

FIG. 1A
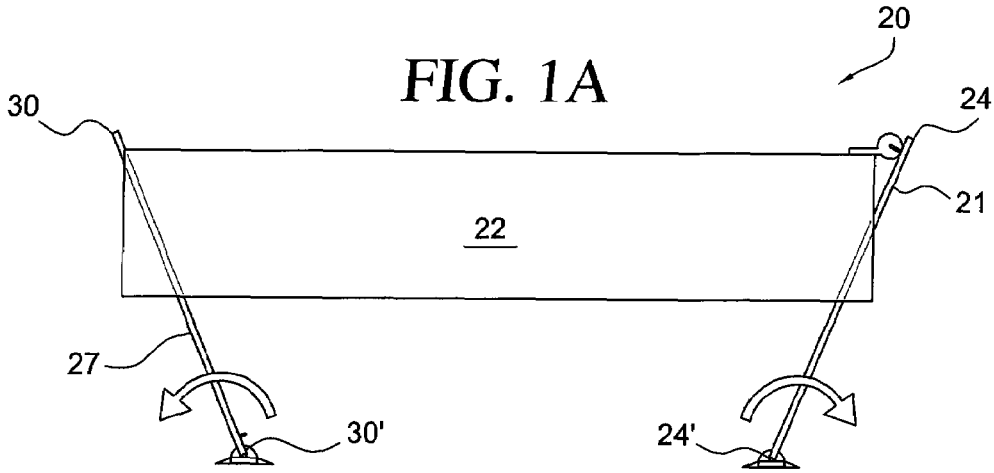
FIG. 1B
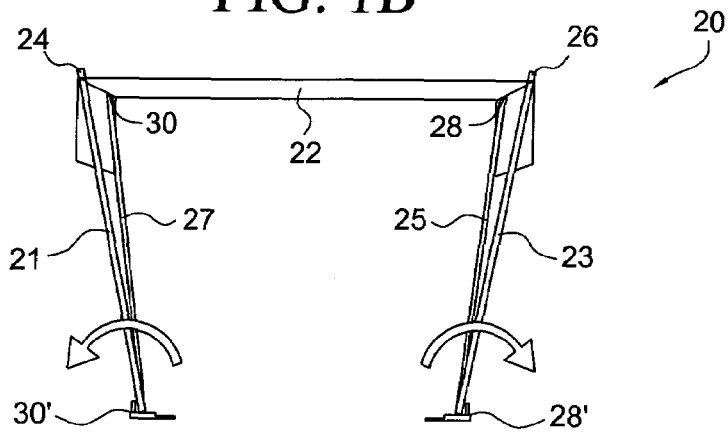
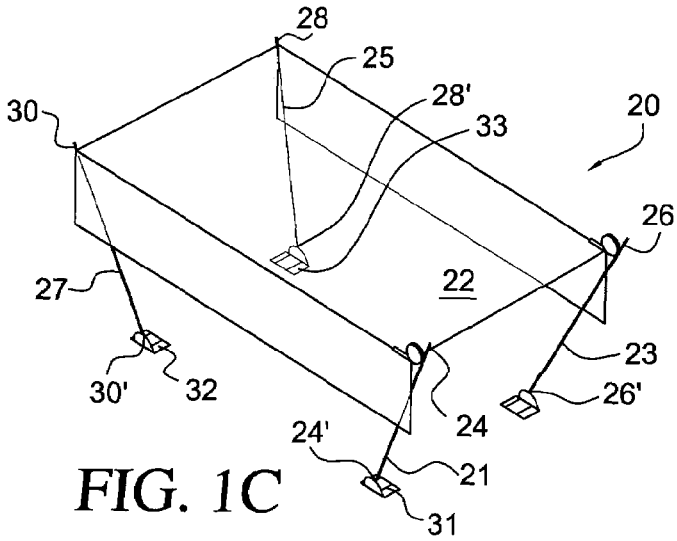
FIG. 1C

PORTABLE CAR COVER

FIELD OF THE INVENTION

This invention relates to a portable car cover and more particularly to a portable car cover for use as a sun shade or the like without resting on the surface of the vehicle.

BACKGROUND FOR THE INVENTION

Car covers for protecting automobiles from the elements are well known. For example, a U.S. Patent of Johnson, U.S. Pat. No. 4,605,030 discloses a portable vehicle structure or sun shade for automobiles which includes a pair of collapsible hoop structures whose upper portions support a fabric shade and whose lower portions are hinged to pads on which the vehicle's tires are parked. A pair of collapsible compression members is locked between the sides of the hoops to maintain the hoops in a shade providing position. A more recent patent of Moyet-Ortiz, U.S. Pat. No. 4,944,321 discloses a portable vehicle garage and tent structure which incorporates support members which in the garage mode are retained under the wheels of a vehicle. The support members have a framework of support poles and cross-members with a cover to shelter the vehicle. When the structure is not positioned to cover a vehicle, it can be used as a tent.

An additional patent of Schlier, U.S. Pat. No. 6,516,822 discloses a portable canopy for use with motor vehicles. The Schlier patent discloses a canopy support assembly including two major sections i.e. a drive on anchoring assembly and a canopy support assembly. The anchoring assembly provides a device wherein a vehicle tire can be driven onto it to prevent movement of the assembly. Pivotally attached to the anchoring assembly is the canopy support that includes at least three telescoping poles. The support assembly can be pivoted onto the anchoring assembly for storage or pivoted to vary the vertical angle of the up standing supports for the poles to accommodate different canopy sizes and shapes depending on the specific application. In use parts of the assemblies are used one under each front or rear tire to provide a canopy.

Notwithstanding the above, it is presently believed that there is a need and a potential marcet for an improved car cover in accordance with the present invention. There should be a demand for such covers particularly in arid climates as well as in the Southern States. In such areas, car covers are sometimes used to protect an automobile's paint and interior from degradation due to heat and ultraviolet rays. The need for such covers is also increased in high density areas due to limited and often high prices for inside parking.

A number of conventional car covers are presently available. However, such covers are usually supported by the surface of a vehicle and allow heat to reach the surface of the vehicle. Further, the cover can scratch the paint due to dirt on a cars surface during installation and removal of the cover and during wind induced movement. It is also believed that the increased cost of motor vehicles and the comfort of drivers and passengers on entering an auto that has been parked in the sun will lead to a greater demand for an improved car cover in accordance with the present invention.

Car covers in accordance with the present invention overcome many of the shortcomings of the conventional covers. For example, such covers provide shade for a parked auto, are portable, relatively secure from theft and maintain a safe distance between the surface of a vehicle and the cover to avoid scratching the surface and provide an opportunity for even a slight breeze to cool the car. In addition, the car covers in accordance with the present invention are relatively light weight and compact for easy storage when not in use. The car covers are relatively easy to install without tools by persons of minimal strength, are durable and relatively inexpensive to manufacture and sell.

BRIEF SUMMARY OF THE INVENTION

In essence the present invention contemplates an improved portable cover for an automobile. Portable covers in accordance with the present invention include a flexible sheet like cover of plastic, fabric or the like and four collapsible legs, each of which has an upper and a lower end. The four legs are each foldable into a compact unit for storage and extended for supporting the flexible cover above the upper surface of an automobile. The portable cover also includes four base members each of which includes an adjustment mechanism attached thereto for supporting and positioning the four collapsible legs. The four base members are held in place by the weight of the car when the car is parked with one of its wheels on each of the base members. Means including the adjustment mechanism are provided for positioning the legs longitudinally and laterally so that the flexible cover extends forwardly or rearwardly over the car i.e. forwardly or rearwardly of the tires. The adjustment mechanism is also used to adjust the legs laterally so that the upwardly extending legs do not touch the sides of the car and the flexible cover extends over the car for a short distance beyond the sides of the auto.

The invention will now be described in connection with the accompanying drawings wherein like reference numbers have been used to identify like parts.

DESCRIPTION OF THE DRAWINGS

FIG. 1A is a side elevational view of a portable car cover in accordance with the present invention;

FIG. 1B is a front elevational view of the portable cover shown in FIG. 1;

FIG. 1C is a perspective view of the car cover shown in FIGS. 1A and 1B;

DESCRIPTION OF THE PREFERRED EMBODIMENTS OF THE INVENTION

Figure 2:
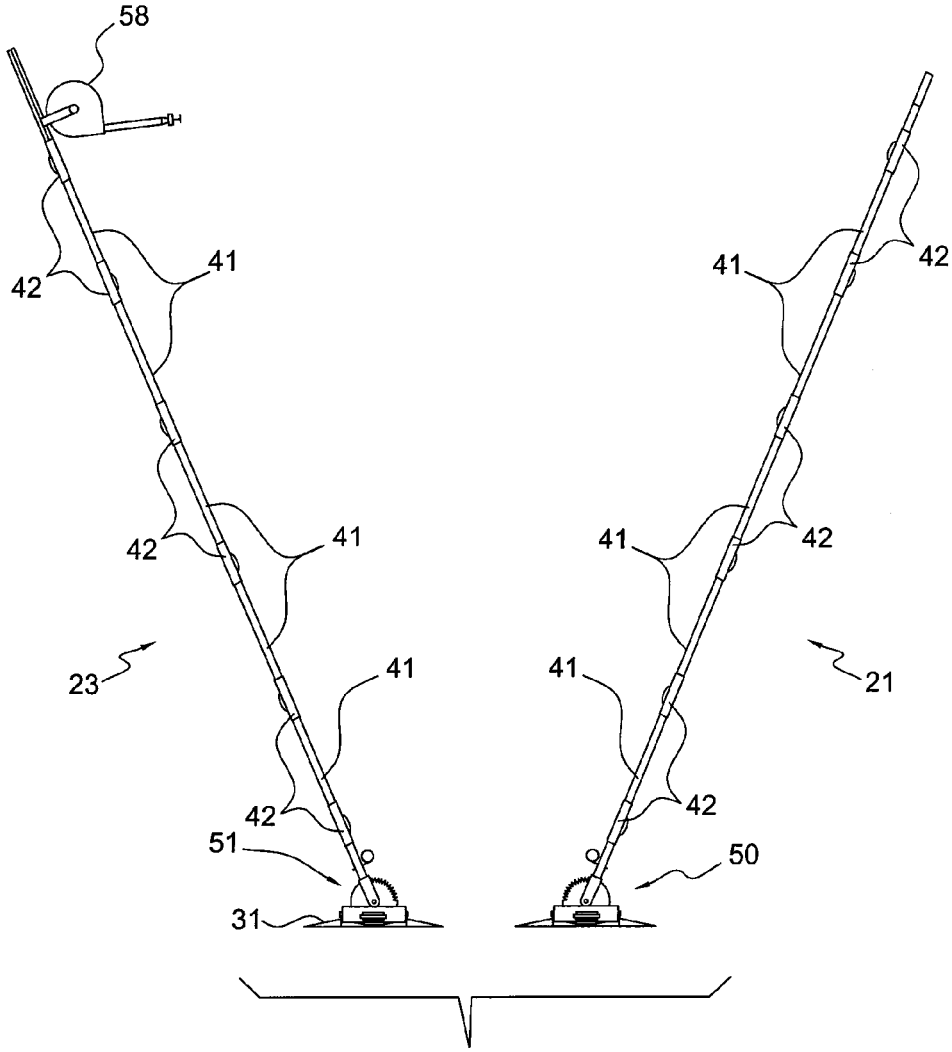
FIG. 2 is a front view illustrating the base members, adjustable members and collapsible legs in an extended position for a portable car cover in accordance with the invention.

FIGS. 1A-1C illustrates a portable car cover 20 in accordance with the present invention. As shown the car cover 20 includes a flexible cover 22 of plastic or fabric sheet like material but preferably a light weight fabric of sufficient capacity to provide shade for an automobile. The flexible cover may also be made of different materials for different climates and conditions and can include a water repellant coating for protection against rain, snow, sleet and hail.

The flexible cover 22 is supported by four collapsible legs 21, 23, 25 and 27 which include upper ends 24, 26, 28 and 30 and lower ends 24', 26' 28' and 30'. The legs 21, 23, 25 and 27 are attached to base members 30, 31, 32 and 33 as will be described in more detail in connection with FIGS. 2 and 3.

Figure 3:
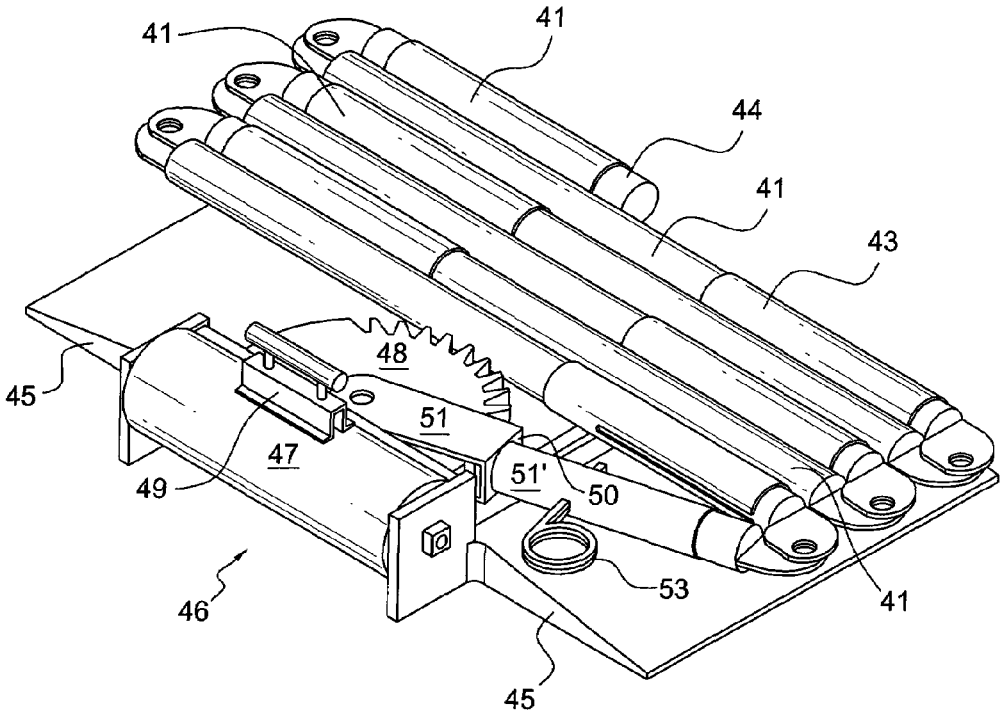
FIG. 3 is a perspective view illustrating a base member, adjustable members and collapsible legs in their folded position for a portable car cover in accordance with the invention.
Figure 4:
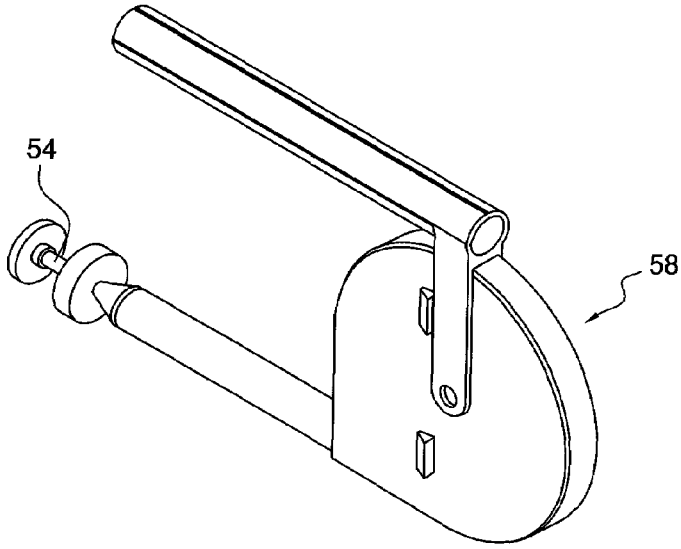
FIG. 4 is a perspective view of a cable and rod connection for use in the present invention.

As illustrated in FIGS. 2 and 3, the collapsible legs 21 and 23 include a plurality of foldable segments 41 and locking elements 42. As illustrated the locking elements 42 may comprise an outer cylindrical element 43 and inner cylindrical element 44 (FIG. 3) wherein the inner cylindrical elements 44 can be forced into an adjacent outer cylinder to provide a rigid leg when in an extended position. These inner cylinders may be spring biased and held in an extended portion by a conventional lock. However, in practice it is anticipated that a detent in each segment and locking protrusion in each adjacent segment may be sufficient to rigidify the collapsible segments 41 when in an extended position. As illustrated each of the segments 41 which are preferably about 12 inches to 18 inches long include a flat segment at each end thereof which are pivotally attached to a flat section of an adjacent segment. Locking elements 42 may slide over the flat sections and an inner cylinder to lock the segments in an extended position.

Each of the legs 21 and 23 for example are attached to the base members 30 and 31 by means of adjustment mechanisms 50 and 51. As illustrated in FIG. 3, the base member 30 which is essentially identical to the other base members include an inclined ramp portion 45 with one ramp portion on a forward portion and the other on a rear portion of the base member. The base member 30 also includes an adjustment mechanism 46 on one side thereof between the inclined ramps. The adjustment mechanism includes a rotatable cylindrical element 47 that carries an arc shaped adjustment member 48 with a series of indentations therein and a locking element 49 for locking the arc shape adjustment member in a generally upright position or in a folded position for storage. The locking arrangement may include a fixed inner cylinder (not shown) with a slot for receiving the element 49 for positioning the arc shaped member 48 in a storage position and a second slot for receiving the element 49 when the arc shape member 48 is in a generally upright position i.e. slightly outside from the side of a vehicle and forwardly and rearwardly from the vehicles tires. It should be recognized that other conventional locking assemblies that permit locking a rotatable element can be used as will be well understood by persons of ordinary skill in the art.

The adjustment mechanism 46 also includes a rotatable fork 50 with a relatively flat leg 51 on each side of the arc shaped member 48. The fork 50 also carries a segment 51' at one end thereof and a second lock 53 for allowing a plunger or pin to engage one of the detents in the arc shaped member 48 to thereby fix the longitudinal angle of one of the collapsible legs. This locking arrangement allows the cover to extend forwardly and reawardly from a tire of the automobile as well as extending over each side of the automobile.

Figure 5:
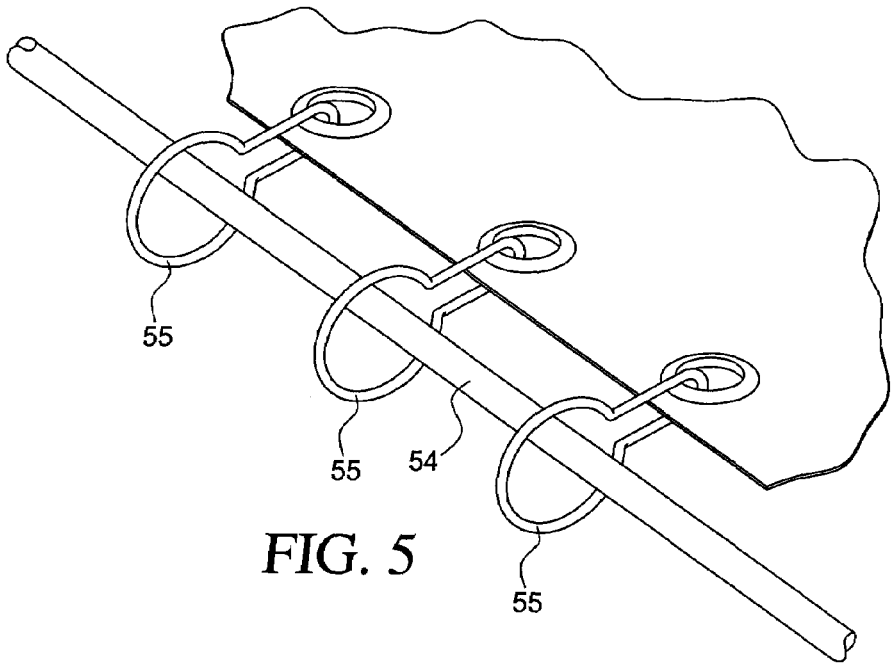
FIG. 5 illustrates a plurality of rings for attaching a side of the flexible cover to a retractable cable as used in the present invention.

A spring biased retractable cable assembly 53 of conventional design is attached at an upper end of each of the collapsible legs 21, 23, 25 and 27. A cable 54 from each assembly 53 is pulled out and attached to an opposite leg to provide a suitable support for the cover 22 as shown in FIG. 1. The cover 22 may be attached by a series of rings 55 to the cable 54 as shown in FIG. 5.

While the invention has been described in connection with its preferred embodiments, it should be recognized that changes and modifications may be made therein without departing from the scope of the appended claims.

What is claimed is:

1. A portable car cover comprising a flexible cover having four corners and four collapsible legs each of which includes an upper end and a lower end for supporting said flexible cover above a car, and four base members each of which includes an adjustment mechanism attached thereto and each of said base members adapted to be held in place near the four corners of a car by being placed under the cars wheels, and said adjustment mechanisms for positioning said upper ends of said legs in a longitudinal and lateral direction include a rotatable cylindrical element and an arc shaped adjustment member having a series of indentations therein carried by said rotatable cylindrical element and a locking element for locking said arc shaped adjustment member in a generally upright position and means for attaching said four corners of said cover to said upper ends of said four legs.

2. A portable car cover according to claim 1 in which said flexible cover is made of fabric.

3. A portable car cover according to claim 1 in which said flexible cover is plastic.

4. A portable car cover according to claim 1 in which each of said base members includes an inclined ramp portion for facilitating moving a car onto said base members.

5. A portable car cover according to claim 4 in which each of said base members includes a relatively flat tire receiving portion and a ramp on two opposite sides of said base member.

6. A portable car cover according to claim 1 in which one of said adjustable mechanisms includes means for adjusting the angle of one of said legs with respect to a longitudinal axis and means for adjusting the angle of one of said legs with respect to a lateral axis.

7. A portable car cover according to claim 6 in which each of said angularly adjustment mechanism includes means for adjusting the angle of one of said legs with respect to a longitudinal axis and means for adjusting the angle of said one of said legs with respect to a lateral axis.

8. A portable car cover according to claim 7 in which each of said adjustment mechanisms include an arcuate member with a series of detents for locking one of said legs in a pre-selected angular position along the longitudinal axis.

9. A portable car cover according to claim 8 in which each of said adjustment mechanisms includes means for locking one of said legs in a pre-selected angular position along a lateral axis.

10. A portable car cover according to claim 1 in which each of said legs has a generally circular cross-section and is foldable into a plurality of relatively short superimposed sections.

11. A portable car cover according to claim 10 which includes a retractable cable for extending between two of said legs and a plurality of rings attached to said flexible cover and extending along said cable to maintain said cover in place on said legs.

12. A portable cover according to claim 11 which includes four retractable cables for connecting all of said legs and in which a series of rings hold each side of said flexible cover to one of said cables.

* * * * *